US010156806B2

(12) United States Patent
Fukuda

(10) Patent No.: US 10,156,806 B2
(45) Date of Patent: Dec. 18, 2018

(54) CORONA DISCHARGER AND UNIT

(71) Applicant: CANON KABUSHIKI KAISHA, Tokyo (JP)

(72) Inventor: Tadashi Fukuda, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/346,999

(22) Filed: Nov. 9, 2016

(65) Prior Publication Data

US 2017/0052471 A1 Feb. 23, 2017

Related U.S. Application Data

(63) Continuation of application No. PCT/JP2015/064126, filed on May 12, 2015.

(30) Foreign Application Priority Data

May 12, 2014 (JP) ..... 2014-099101

(51) Int. Cl.
*G03G 15/02* (2006.01)

(52) U.S. Cl.
CPC ..... *G03G 15/0258* (2013.01); *G03G 15/0291* (2013.01); *G03G 2215/0129* (2013.01); *G03G 2215/027* (2013.01)

(58) Field of Classification Search
CPC ..... G03G 15/0233; G03G 15/0258; G03G 15/0291; G03G 2215/027
See application file for complete search history.

(56) References Cited

U.S. PATENT DOCUMENTS 5,177,534 A 1/1993 Kisu et al.
5,424,540 A * 6/1995 Garcia ..... H01T 19/00 250/324
2007/0020403 A1 1/2007 Yoshitake et al.
2009/0304410 A1* 12/2009 Tanaka ..... G03G 15/0258 399/100

FOREIGN PATENT DOCUMENTS

JP 60050555 A * 3/1985 ..... G03G 15/0291
JP 03-174564 A 7/1991
JP 05-265304 A 10/1993
(Continued)

OTHER PUBLICATIONS

Mikami, et al., "Structure and Thermal Stability of the Chemical Bondings of Diamond-Like Carbon (DLC) Films Prepared by RF Magnetron Sputtering", Journal of the Surface Science Society of Japan, vol. 24, No. 7, 2003, pp. 411-416.
(Continued)

*Primary Examiner* — Erika J Villaluna
(74) *Attorney, Agent, or Firm* — Venable, LLP

(57) ABSTRACT

A corona discharger includes a discharge wire and holding portions for holding the discharge wire at longitudinal opposite end portions thereof. The discharge wire comprises a base material of metal, and a surface layer of the material comprises carbon on a part thereof. The discharge wire includes a coated region coated with the surface layer, and non-coated regions at opposite sides of the coated region with respect to the longitudinal direction of the discharge wire. Opposite end portions of the discharge wire are in the non-coated regions.

10 Claims, 8 Drawing Sheets

(56) References Cited

FOREIGN PATENT DOCUMENTS

| | | | |
|---|---|---|---|
| JP | 2000-058225 | A | 2/2000 |
| JP | 2003-045610 | A | 2/2003 |
| JP | 2003-263041 | A | 9/2003 |
| JP | 2005-015325 | A | 1/2005 |
| JP | 2008-102433 | A | 5/2008 |
| JP | 2010-224062 | A | 10/2010 |

OTHER PUBLICATIONS

International Search Report and Written Opinion dated Jul. 7, 2015 in PCT/JP2015/064126.
Office Action dated Dec. 19, 2017, in Japanese Patent Application No. 2014-099101.

* cited by examiner

Diamond-like carbon

CARBON ATOMS

COVALENT BOND (tetrahedral amorphous Carbon : ta-C)

CORONA DISCHARGER AND UNIT

FIELD OF THE INVENTION

The present invention relates to a corona discharger and a unit having the corona discharger usable with an image forming apparatus such as a copying machine, a printer, a facsimile machine or the like using an electrophotographic type or electrostatic recording type process, for example.

BACKGROUND ART

Conventionally, in the image forming apparatus using the electrophotographic type process, for example, a surface of an electrophotographic photosensitive member (photosensitive member) is charged by a charger and thereafter, the charged surface of the photosensitive member is exposed to light in accordance with image information, so that an electrostatic latent image is formed on the surface of the photosensitive member. As for the charger for charging the surface of the photosensitive member, a corona discharger (corona discharge generator) is widely used.

Generally, a discharging electrode of the corona discharger is made of an electroconductive member such as a metal and is disposed spaced from the photosensitive member by the predetermined gap. By applying a high voltage to the discharging electrode, the photosensitive member as the member to be charged is charged using the discharge from the discharging electrode.

The shape of the discharging electrode is needle configuration having multiple needle-like electrodes (needle-like electrode array), a wire configuration in which wire per se is used as the electrode, or a strip configuration. The discharging electrode is repeatedly used, and therefore, the discharging electrode may be contaminated by foreign matter which may disturb the discharge.

Patent document 1 is directed to the problem in which the discharging electrode is contaminated by foreign matter such as silica with the result of disturbance to the corona discharge, and proposes that the surface of the discharging electrode is coated with film of carbon including diamond (carbon film which is a film made of a material comprising carbon). Such a carbon film is capable of suppressing the deposition of the foreign matter to the discharging electrode and enhancing the durability of the discharging electrode, and therefore, it is effective as a surface layer constituting a protection layer for the discharging electrode.

PRIOR ART REFERENCE

Patent Document

[Patent Document 1] Japanese Laid-open Patent Application No. 2000-58225

SUMMARY OF THE INVENTION

Problem To Be Solved

The surface layer of the carbon film has high hardness and high durability. However, when the surface layer formation portion is bent (greatly curved), when a part thereof receives a high-pressure, or when there is a boundary between the surface layer formation area and an area not coated with the surface layer, the surface of the surface layer is easily cracked or peeled.

That is, a wire discharging electrode (discharge wire), for example, is ordinarily fixed with a certain degree of tension in order to maintain a constant gap relative to the photosensitive member. When the discharge wire is fixed, the discharge wire is tied on a fixing member, is circled and hooked with a projection, or is nipped by a screw or plate-like members. Therefore, the discharge wire is bent, or a pressure is imparted to a part of the discharge wire. Additionally, by the discharge wire being pressed by positioning members or the like, the discharge wire may be bent, or a part of the discharge wire is locally pressed. In the case that the surface layer is provided, the bending, the nipping or the pressing of the discharge wire tends to crack the surface of the surface layer. In addition, in the case that the boundary portion between the surface layer formation area and non-formation area exists, the surface of the surface layer is likely to be cracked by the contact of a cleaning member thereto. Once the crack is produced at a part, the surface layer is easily broken or peeled from the crack.

In the foregoing description, the case that the corona discharger is charging means for charging the photosensitive member is given, but the corona discharger may be used for another purpose in the image forming apparatus. For example, the corona discharger is used as charging means for applying charge to the toner carried on the image bearing member such as the photosensitive member, discharging means for removing the electric charge from the image bearing member such as the photosensitive member, transferring means for transferring the toner from the image bearing member such as the photosensitive member onto a transfer material, or the like. The above-discussed problems may arise in any of such usage.

Accordingly, it is an object of the present invention to provide a corona discharger and a unit with which the production of cracks on the surface layer of a discharge wire can be suppressed.

Means For Solving The Problem

The object is accomplished and by the corona discharger and unit according to the present invention.

In summary, according to a first aspect of the invention, there is provided a corona discharger comprising a discharge wire stretched in said corona discharger and configured to electrically discharge by being supplied with a voltage, said discharge wire including a base material of metal, and a surface layer comprising diamond-like carbon formed on said base material; a first connecting portion configured to connect one end portion of said discharge wire; a second connecting portion configured to connect the other end portion of said discharge wire, wherein said discharge wire includes a coated region coated with said surface layer and non-coated regions not coated with said surface layer in opposite sides of the coated region with respect to a longitudinal direction of said discharge wire, respectively, and wherein the one end portion and the other end portion of said discharge wire are in the non-coated regions, respectively.

According to a second aspect of the invention, there is provided a corona discharger comprising a discharge wire stretched in said corona discharger and configured to electrically discharge by being is supplied with a voltage, said discharge wire including a base material of metal, a surface layer comprising diamond-like carbon formed on said base material; and a cleaning member configured to clean said discharge wire by moving along a longitudinal direction of said discharge wire in contact with said discharge wire, wherein said discharge wire includes a coated region coated with said surface layer and a non-coated region not coated with said surface layer, and a contact region in which said cleaning member contacts said discharge wire during a cleaning operation of said cleaning member is in the coated region, and a boundary portion between the coated region and the non-coated region is outside the contact region with respect to the longitudinal direction of said discharge wire.

According to another aspect of the present invention, there is provided a unit comprising a corona discharger according to the first invention, and a rotatable photosensitive member to be charged by said corona discharger, wherein a toner image is capable of being formed on a surface of said photosensitive member charged by said corona discharger, and wherein a region, with respect to the longitudinal direction of said discharge wire, of said discharge wire corresponding to a maximum area in which the toner image is formed with respect to a longitudinal direction of said photosensitive member is in the coated region.

Effect of the Invention

According to the present invention, the production of a crack on the surface layer of the discharge wire can be suppressed.

DESCRIPTION OF THE EMBODIMENTS

A corona discharger and a unit according to the present invention will be described in detail, referring to the accompanying drawings.

Embodiment 1:

1. General Arrangement and Operation of Image Forming Apparatus

Figure 1:
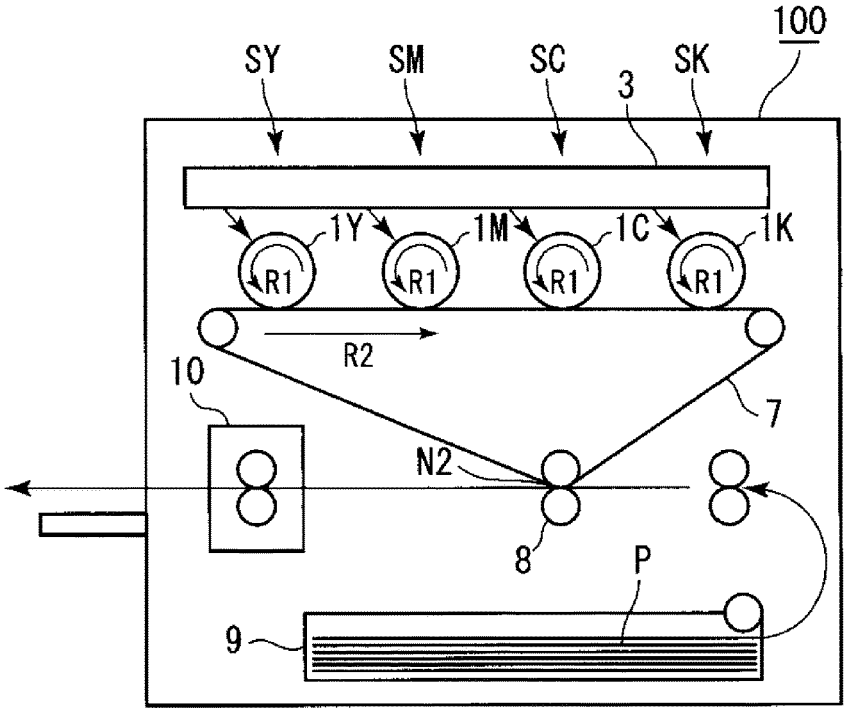
FIG. 1 is a schematic sectional view of an image forming apparatus.

FIG. 1 is a schematic sectional view illustrating a structure of an image forming apparatus 100 according to an embodiment of the present invention. The image forming apparatus 100 of this embodiment is an intermediary transfer type and tandem type printer capable of outputting full-color images.

The image forming apparatus 100 comprises first, second, third and fourth image forming stations SY, SM, SC and SK as a plurality of image forming stations. The image forming stations SY, SM, SC, SK form yellow (Y), magenta (M), cyan (C) and black (K) toner images, respectively.

In this embodiment, the structures and operations of the image forming stations SY, SM, SC, SK are substantially the same except for kinds (spectral characteristics, color) of the toners for developing electrostatic latent images. In the following description, therefore, they will be described commonly without suffixes Y, M, C, K indicating the respective colors, unless distinction is required.

Figure 2:
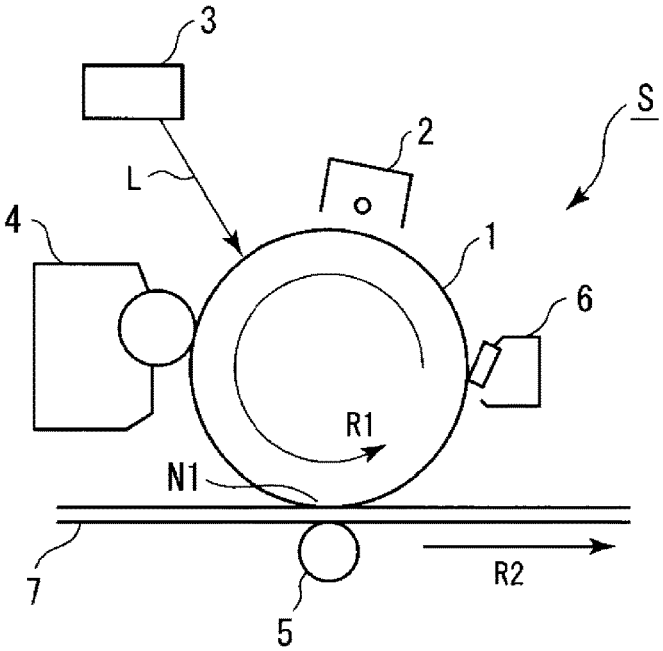
FIG. 2 is a schematic sectional view of an image forming station of the image forming apparatus of FIG. 1.

FIG. 2 is a schematic sectional view showing an image forming station S in detail. The image forming station S includes a photosensitive drum 1 which is a drum type (cylindrical) electrophotographic photosensitive member (photosensitive member) as an image bearing member. The photosensitive drum 1 is rotationally driven in a direction indicated by an arrow R1 in the Figure. Around the photosensitive drum 1, there are provided various means along the rotational direction. First, a charger 2 in the form of a corona discharger as charging means for charging the photosensitive drum 1 is provided. Next, an exposure device (laser scanner device) 3 as exposure means is provided. Next, a developing device 4 as developing means is provided. Next, a primary transfer roller 5 which is a roller type primary transfer member as primary transferring means is provided. Next, a drum cleaning device 6 as photosensitive member cleaning means is provided. Of these elements in the image forming station, at least photosensitive drum 1 and corona discharger are contained in a process unit as a unit.

Opposed to the four photosensitive drums 1Y, 1M, 1C and 1K, there is provided an intermediary transfer belt 7 in the form of an endless belt as an intermediary transfer member. Intermediary transfer belt 7 is stretched around three rollers, and one of them is a driving roller for rotation of the driving the intermediary transfer belt 7 in the direction indicated by an arrow R2 in the Figure. Inside the intermediary transfer belt 7, the primary transfer roller 5 is provided at a position opposing the photosensitive drum 1. The primary transfer roller 5 is urged (pressed) toward the photosensitive drum 1 through the intermediary transfer belt 7 to constitute a primary transfer portion N1 in which the intermediary transfer belt 7 and the photosensitive drum 1 contact with each other. Outside the intermediary transfer belt 7, there is provided a secondary transfer roller 8 which is a secondary transfer member in the form of a roller as secondary transferring means, and a position opposing an opposing roller which is one of the three rollers. The secondary transfer roller 8 is urged (pressed) toward the opposing roller through the intermediary transfer belt 7 therebetween to constitute a secondary transfer portion N2 in which the intermediary transfer belt 7 and the secondary transfer roller 8 contact with each other.

The image forming apparatus 100 further comprises a feeding device for feeding a recording material P to the secondary transfer portion N2, and a fixing device for fixing the toner image on the recording material P.

During image forming operation, the surface of the rotating photosensitive drum 1 is substantially uniformly charged by the charger 2. Thereafter, the charged surface of the photosensitive drum 1 is exposed and scanned by an exposure device 3 in accordance with image information. By this, the electrostatic latent image (electrostatic image) is formed on the photosensitive drum 1 in accordance with the image information. The electrostatic latent image formed on the photosensitive drum 1 is developed (visualized) into a toner image when the toner contained in the developing device 4 is supplied. The toner image formed on the photosensitive drum 1 is transferred (primary-transfer) onto the intermediary transfer belt 7 by the function of the primary transfer roller 5 in the primary transfer portion N1. In the formation of a full-color image, for example, the above-described operations are carried out by the image forming stations SY, SM, SC, SK, and the respective color toner images are superimposedly transferred onto the intermediary transfer belt 7. The toner (primary-untransferred toner) remaining on the photosensitive drum 1 without being transferred onto the intermediary transfer belt 7 is removed by a drum cleaning device 6 including a cleaning blade and is collected.

The toner image transferred onto the intermediary transfer belt 7 is transferred (secondary-transfer) onto the recording material P by the function of the secondary transfer roller 8 in the secondary transfer portion N2. The recording material P is fed out of a cassette 9 in the feeding device as feeding means to the secondary transfer portion N2 in synchronism with the toner image on the intermediary transfer belt 7. The toner (secondary-untransferred toner) remaining on the intermediary transfer belt 7 without being transferred onto the recording material P is removed by an unshown belt cleaning device as intermediary transfer member cleaning means and is collected.

The recording material P having the transferred toner image is fed into the fixing device 10 as the fixing means. In the fixing device 10, the recording material P is nipped and fed by a rotatable heating member contacting the toner and a pressing rotatable member. By this, the toner is heated and fused to be fixed on the recording material P. Thereafter, the recording material P having the fixed image is discharged to an outside of the image forming apparatus 100.

2. Fundamental Structure of Charger

A fundamental structure of the corona discharger used as the charger 2 in this embodiment will be described. For the image forming apparatus 100 and the elements of the image forming apparatus 100, the front side is a front side of the sheet of the drawing of FIGS. 1 and 2, and the rear side is a rear side of the sheet of the drawing. A depth direction connecting the front side and the rear side is substantially parallel with a longitudinal direction (rotational axis direction) of the photosensitive drum 1. The left and right are the left-hand side and the right-hand side as seen from the front side.

Figure 3:
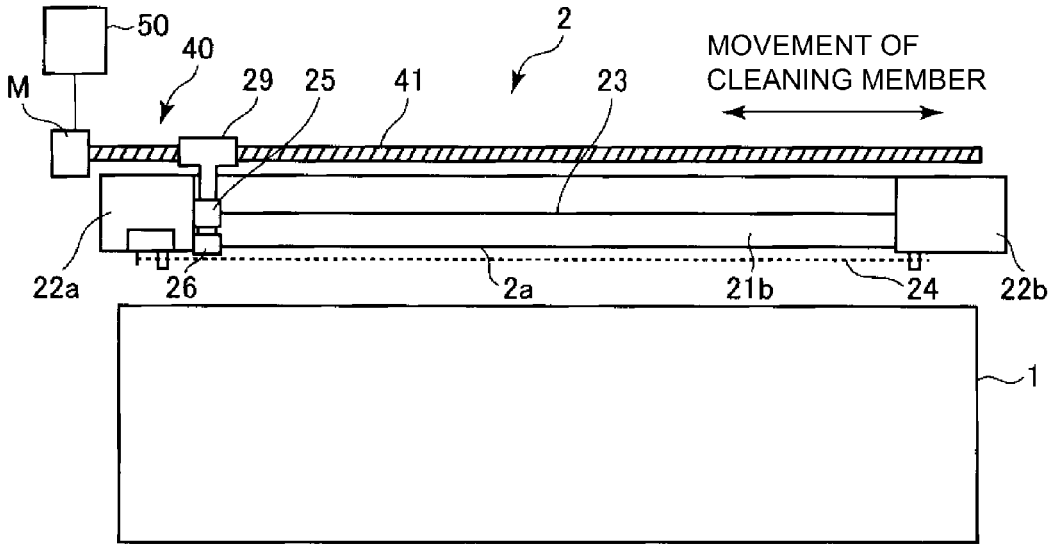
FIG. 3 is a schematic longitudinal sectional view of a corona discharger.
Figure 4:
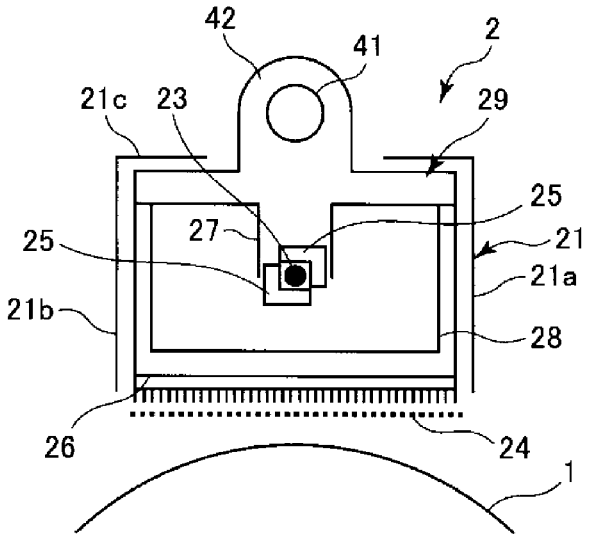
FIG. 4 is the schematic cross-sectional view of the corona discharger.
Figure 5:
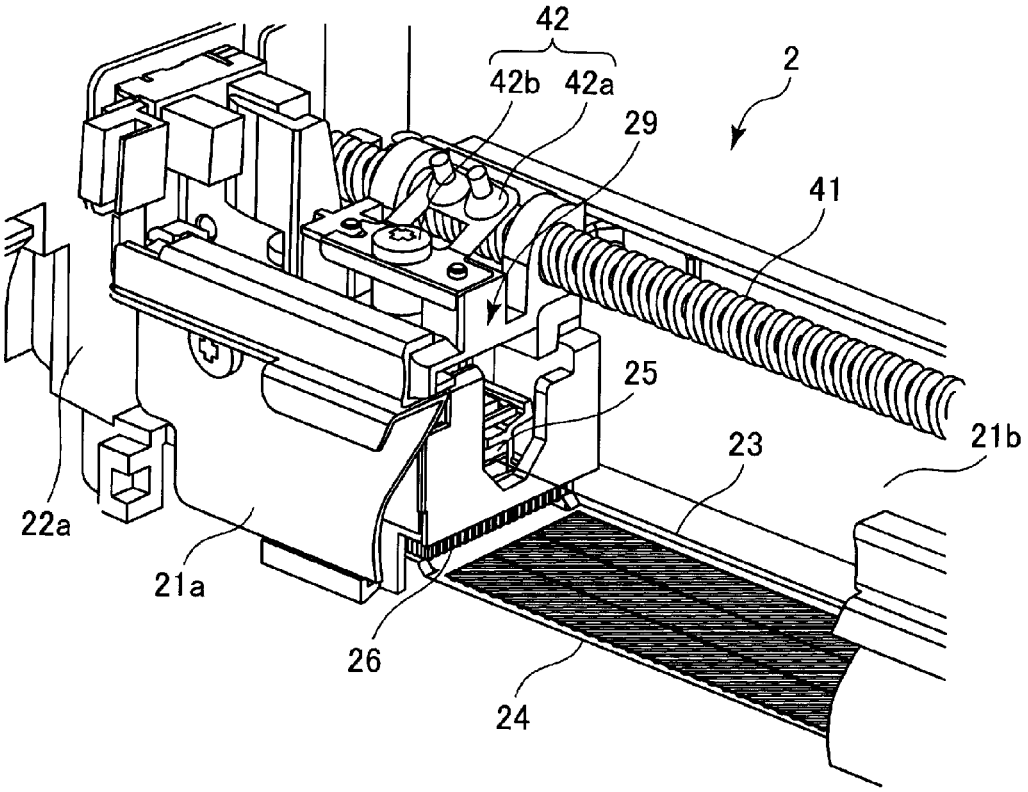
FIG. 5 is a partly cut-away perspective view of one end portion of the corona discharger.

FIG. 3 is a longitudinal sectional view of the charger 2, in which the left side is a front side of the charger 2, and the right side is the rear side. FIG. 4 is a cross-sectional view of the charger 2 as seen from the front side. FIG. 5 is a perspective view of the front side of the charger 2 as seen from an upper side.

In this embodiment, the charger 2 for charging the surface of the photosensitive drum 1 is a corona discharger (corona discharge generator), more particularly, scorotron. The charger 2 includes a shield case 21 which is a casing of the charger 2 having one open side. Longitudinal opposite end portions of the shield case 21 are provided with a front block 22*a* and a rear block 22*b*, respectively, and between the front block 22*a* and the rear block 22*b*, a discharge wire 23 as a discharging electrode is extended (stretched). In the open side of the shield case 21, a grid member 24 as a controlling electrode is provided between the discharge wire 23 and the photosensitive drum 1. The charger 2 is positioned such that the open side of the shield case 21 is opposed to the photosensitive drum 1 (member to be charged by the charger 2) in close proximity with the photosensitive drum 1. In this embodiment, the charger 2 is disposed extended along a generatrix of the photosensitive drum 1, and therefore, the longitudinal direction of the charger 2 is substantially parallel with the longitudinal direction (rotational axis direction) of the photosensitive drum 1.

The charger 2, therefore, includes the discharge wire 23 as the discharging electrode standing along the longitudinal direction (substantially parallel in this embodiment) of the charger 2, and the shield case 21 enclosing the discharge wire 23. The shield case 21 includes a right-hand shield member 21*a* and a left-hand shield member 21*b* extending along the longitudinal direction (substantially parallel in this embodiment) of the discharge wire 23 so as to oppose each other with the discharge wire 23 interposed therebetween. In addition, the shield case 21 includes a top shield member 21*c* extending along the longitudinal direction of the discharge wire 23 (substantially parallel in this embodiment) at a position opposed to the photosensitive drum 1 so as to have the discharge wire 23 interposed therebetween. In addition, the charger 2 includes the grid member 24 as the controlling electrode extending along the longitudinal direction of the discharge wire 23 (substantially parallel in this embodiment) between the discharge wire 23 and the photosensitive drum 1 in an opening 2*a* of the shield case 21 opposed to the photosensitive drum 1.

In this embodiment, the shield member (right-hand shield member, left-hand shield member and top shield member) 21*a*, 21*b* and 21*c* are provided by machining metal plate-like members as the electroconductive members. The surfaces of the right-hand shield member 21*a* and the left-hand shield member 21*b* opposed to the discharge wire 23 are substantially flat and are substantially parallel with each other. The top shield member 21*c* connects the right-hand shield member 21*a* and the left-hand shield member 21*b* at a side remote from the photosensitive drum 1, and the top shield member 21*c* is provided with an opening for permitting movement of a holder 29.

The discharge wire 23 is stretched along the longitudinal direction of the charger 2 in a space enclosed by the shield case 21. To the discharge wire 23, a high voltage is applied from an unshown high voltage source. By this, the corona discharge is produced to apply electric charge on the photosensitive drum 1. The discharge wire 23 is preferably metal wire as an electroconductive member. The metal may comprise at least one of tungsten, molybdenum, iron, nickel, cobalt, chromium and titanium. Among them, the material of the discharge wire 23 is preferably a metal material such as stainless steel, nickel, molybdenum tungsten or the like. In this embodiment, tungsten is used which has a very high stability among the metal materials. A diameter of the discharge wire 23 is preferably 40 μm-100 μm. In this embodiment, the discharge wire 23 comprises a base material of tungsten wire having a diameter of 60 μm and a protection layer as a surface layer.

In this embodiment, the surface of the tungsten wire as the base material is coated with the protection layer (protecting film) of Tetrahedral Amorphous Carbon (ta-C) film. The details of the structure of the protection layer on the surface of the discharge wire 23 and a film formation range will be described hereinafter. A film formation method of the protection layer will be described in detail hereinafter.

The grid member 24 is stretched along the longitudinal direction of the charger 2 at a position closer to the photosensitive drum 1 than the discharge wire 23. In this embodiment, the grid member 24 is a flat plate-like etching grid. To the grid member 24, a high voltage is applied from an unshown high voltage source which is different from the high voltage source connected with the discharge wire 23. By applying a predetermined voltage to the grid member 24, a current flowing from the discharge wire 23 to the photosensitive drum 1 is controlled to converge the charged potential of the photosensitive drum 1 to a desired potential.

In this embodiment, the grid member 24 comprises a base material plate of austenitic stainless steel (SUS304) having a thickness of approx. 0.03 mm, which is etched to provide a mesh pattern having a great number of through pores.

3. Discharge Wire Mounting Method

The discharge wire 23 is stretched such that the distance between the discharge wire 23 and the photosensitive drum 1 is substantially constant, for the purpose of providing charging uniformity along the longitudinal direction of the photosensitive drum 1. The charging uniformity in the longitudinal direction of the photosensitive drum 1 is required in the area in which the image is formed, and therefore, the discharge wire 23 is stretched such that the distance between the discharge wire 23 and the photosensitive drum 1 is substantially constant at least in the image forming region with respect to the longitudinal direction of the photosensitive drum 1. Here, the substantial constant distance between the discharge wire 23 and the photosensitive drum 1 typically means within ±2.0 mm.

The discharge wire 23 is a thin metallic wire. Therefore, in order to make the distance between the discharge wire 23 and the photosensitive drum 1 constant, it is desirable that a certain degree of tension is applied to the discharge wire.

Figure 6:
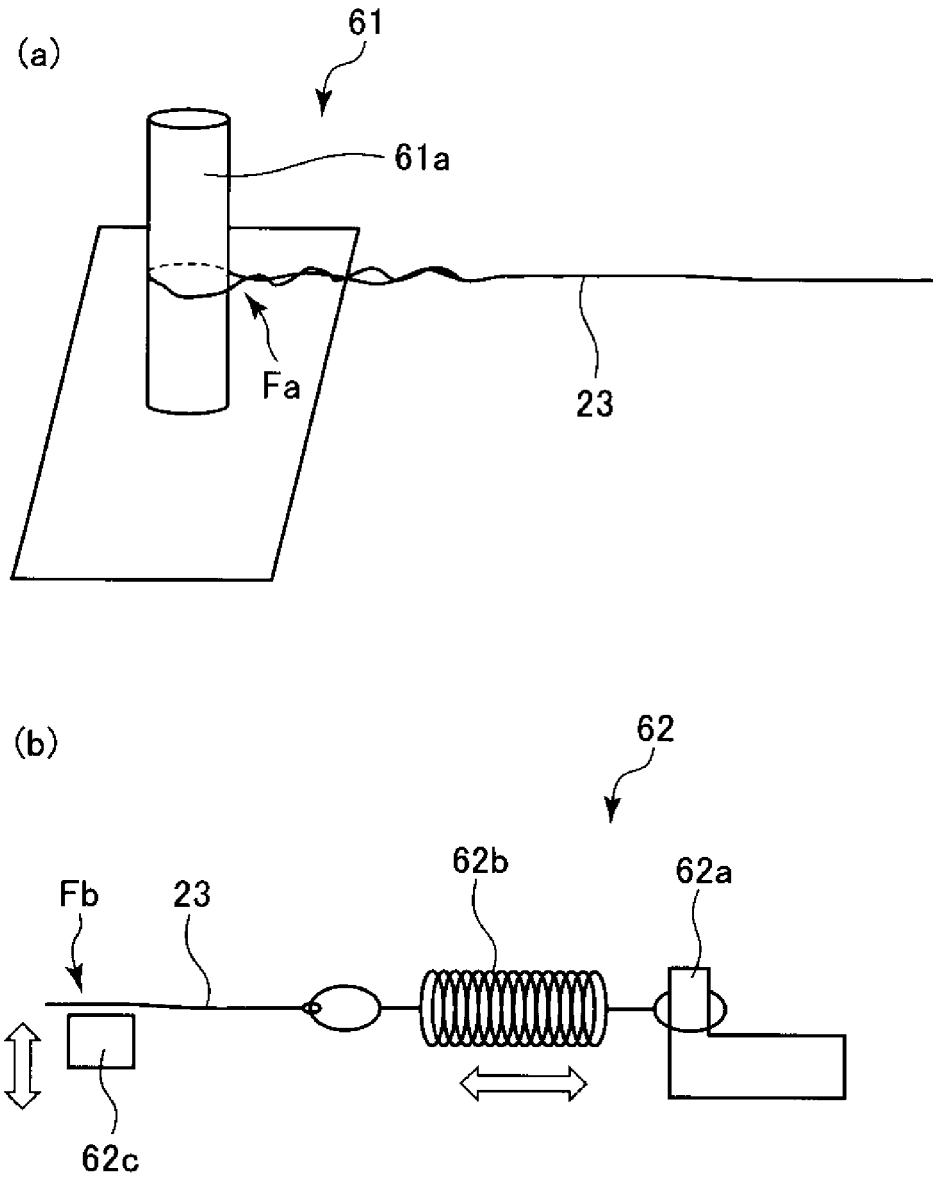
FIG. 6 is a schematic view of an example of a mounting method of a discharge wire of the corona discharger.

Parts (a) and (b) of FIG. 6 are schematic views illustrating a mounting method at the front side and rear side of the charger 2 in this embodiment. In this embodiment, there are provided a front holding portion 61 and a rear holding portion 62 as a holding portion, in which a front block 22*a* and a rear block 22*b* are hollow.

More particularly, as shown in part (a) of FIG. 6, the front holding portion 61 includes a front projection 61*a* as a first connecting portion. One of the end portions at the front side of the charger 2 with respect to the longitudinal direction (axial direction) of the discharge wire 23 is tied on the front projection 61*a*. In this embodiment, the portion of the discharge wire 23 around the front projection 61*a* and the tied portion thereof are connecting positions Fa which require the discharge wire 23 to be bent in the front side of the charger 2.

On the other hand, as shown in part (b) of FIG. 6, the rear holding portion 62 includes a rear projection 62*a* as a mounting portion, a spring 62*b* which is an urging member as a tension applying means, and an urging member 62*c* as distance adjusting means. There is a method in which the longitudinal opposite ends of the discharge wire 23 are tied on projections, and the tension is applied. With such a method, however, the application of the tension such as to maintain the constant distances between the discharge wire 23 and the photosensitive drum 1 is not easy, because the discharge wire 23 per se does not have enough ductility. Therefore, the other end portion with respect to the longitudinal direction of the discharge wire 23 in the rear side of the charger 2 is tied to the spring 62*b* as the second connecting portion, and the spring 62*b* is hooked on the rear projection 62*a*. The discharge wire 23 is subjected to the tension by the spring 62*b*, so that the distance between the discharge wire 23 and the photosensitive drum 1 can be maintained constant. Additionally, the urging member 62*c* as the distance adjusting means is provided in the front side (inside) of the portion of the connection between the discharge wire 23 and the spring 62*b*, in the charger 2. The discharge wire 23 is hooked on the urging member 62*c*. The urging member 62*c* is movable to adjust the distance between the discharge wire 23 and the photosensitive drum 1. That is, by the urging member 62*c*, the position of the discharge wire 23 in the corona discharger can be adjusted. The urging member 62*c* as the distance adjusting means may be provided in each of the front holding portion 61 and the rear holding portion 62, but in this embodiment, it is provided in only one of them, that is, the rear holding portion 62. The pressure is imparted on the portion (pressed portion) of the discharge wire 23 which contacts the urging member 62*c*. In this embodiment, the portion where the discharge wire 23 contacts the urging member 62*c* is a positioning portion Fb where a part of the discharge wire 23 is required to be pressed in the rear side of the charger 2.

Figure 7:
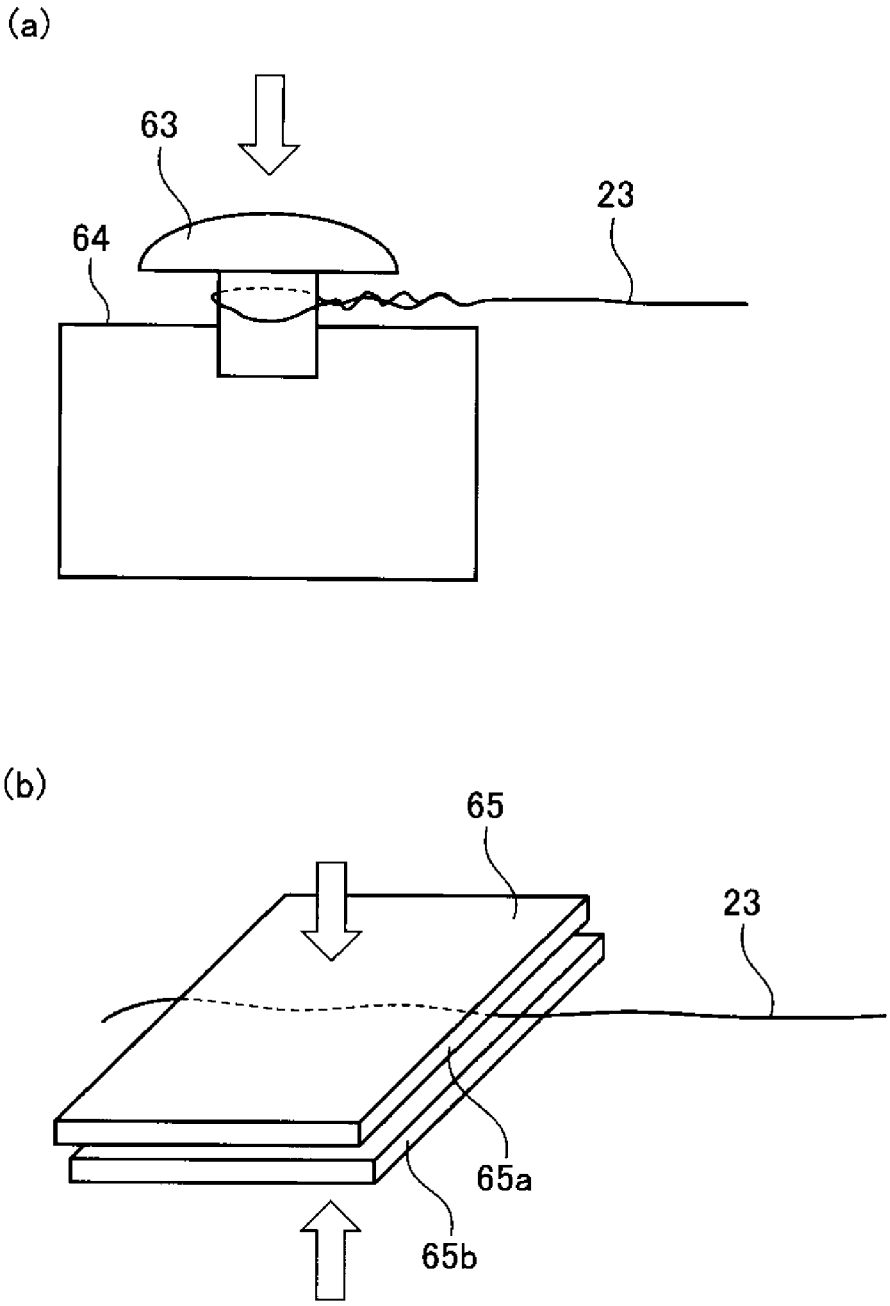
FIG. 7 is a schematic view of another example of the mounting method of the discharge wire of the corona discharger.

As shown in part (a) of FIG. 7, the mounting method of the discharge wire 23 may be tying on a screw 63 as the fastening member connected (screwed) to the base member 64, or may nip the discharge wire 23 between the screw 63 and the base member 64 in place of or in addition to the tying. In the case of nipping the discharge wire 23 using the screw 63, a washer may be provided between the discharge wire 23 and the underhead (seat) of the screw 63. Alternatively, as shown in part (b) of FIG. 7, the mounting method of the discharge wire 23 may be nipping and a fixing the discharge wire 23 by applying pressure from one of or both of flat plates 65*a*, 65*b* as nipping members.

In any mounting method and distance adjustment method, it is ordinarily necessary to apply a pressure to a part of the discharge wire or to bend for tying.

Because the discharge wire 23 is supplied with a high voltage, the members such as the above-described mounting portion (projection), distance adjusting means (urging member), fastening member (screw), and nipping member (flat plate) are preferably incombustible.

4. Cleaning of Discharge Wire and Grid Member

With repetition of the image forming operation, foreign matter such as fine particles (electric discharge product, powder dust, scattered toner or externally added material) floating in the charger 2 may be deposited on the surface of the discharge wire 23 and the grid member 24. When the foreign matter is deposited on the discharge wire 23 and the grid member 24, the charged potential of the photosensitive drum 1 at the position of the foreign matter in the main scan direction may be different from the normal potential with the result of image density non-uniformity attributable to the non-uniform charging. In this embodiment, the main scan direction is substantially parallel with the longitudinal direction of the photosensitive drum 1 and the charger 2. Therefore, in this embodiment, in order to remove the deposited foreign matter, the discharge wire 23 and the grid member 24 are cleaned.

4-1. Cleaning Member:

Referring to FIGS. 3 and 4, the description will be made as to the discharge wire 23 and the grid member 24. The charger 2 includes a cleaning pad 25 as an electrode cleaning member for cleaning the discharge wire 23 and a cleaning brush 26 as a grid cleaning member for cleaning the grid member 24.

The cleaning pad 25 is provided so as to nip the discharge wire 23, and rubs the discharge wire 23 by moving along the longitudinal direction of the discharge wire 23. The cleaning pad 25 is supported by a cleaning pad and a supporting portion 27. The cleaning pad 25 is detachably mounted to the cleaning pad supporting portion 27.

The cleaning brush 26 is disposed so as to contact the discharge wire 23 side surface of the grid member 24 and rubs the grid member 24 by moving in the longitudinal direction of the discharge wire 23. Cleaning brush 26 is supported by the cleaning brush supporting portion 28. The cleaning brush 26 is detachably mounted to the cleaning brush supporting portion 28. In this embodiment, in order for the cleaning brush 26 not to apply unnecessary stress to the grid member 24 during the image forming operation, the cleaning brush 26 is spaced from the grid member 24 when it is placed in the stand-by position (home position) thereof In addition, the cleaning brush supporting portion 28 supporting the cleaning brush 26 adjacent to each of the opposite end portions of the cleaning brush 26 is provided with a grid guide portion (unshown) for guiding the grid member 24 with respect to the vertical direction to assure the cleaning. During the cleaning operation for the grid member 24, the grid guide portion functions to maintain a substantially constant height relationship between the grid member 24 and the cleaning brush 26. By this, the cleaning operation can be carried out while maintaining the contact pressure and the predetermined virtual bite between the grid member 24 and the cleaning brush 26.

The cleaning pad supporting portion 27 and the cleaning brush supporting portion 28 are connected integrally with each other to constitute a holder 29 as a holding member. The holder 29 holds the cleaning pad 25 and the cleaning brush 26 and moves along the longitudinal direction of the discharge wire 23 by being driven by a moving mechanism which will be described hereinafter in detail. By this, the cleaning pad 25 and the cleaning brush 26 are moved in the longitudinal direction of the discharge wire 23, thus cleaning the discharge wire 23 and the grid member 24. The holder 29 is in the example of a movable member movable along the longitudinal direction of the discharge wire 23.

The cleaning pad 25 includes foam and an incombustibility-treated felt on the surface thereof. The cleaning pad 25 nips the discharge wire 23 at the opposite sides. By the sponge nipping the discharge wire 23 with such a pressure that the sponge deforms to a certain extent, the cleaning pad 25 contacts the whole peripheral surface of the discharge wire 23. As the member contacting the surface of the discharge wire 23 to clean it, a sheet coated with an abrading material such as alumina, silicon carbide or the like may be used. However, an elastic member is preferably provided to assure the contact to the whole peripheral surface of the discharge wire 23.

The cleaning brush 26 includes an incombustibility-treated acrylic brush woven in a base textile. Alternatively, use can be made of a brush member of nylon, PVC (polyvinyl chloride), PPS (polyphenylenesulfide resin material) or the like. In addition, it is not limited to the planted fur type, and use can be made of an elastic member such as felt, sponge or the like, or a sheet coated with an abrading material such as silicon carbide or the like.

4-2. Moving Mechanism for Cleaning Member:

Referring to FIGS. 3, 4, the moving mechanism (driving mechanism) of the cleaning member will be described. As described hereinbefore, in this embodiment, the cleaning pad 25 as the electrode cleaning member and the cleaning brush 26 as the grid cleaning member are integrally and simultaneously moved by the holder 29 as the movable member. The holder 29 is regulated in the moving direction by the rail (unshown) provided on the upper part of the shield case 21, and is reciprocated along the longitudinal direction of the discharge wire 23.

In this embodiment, the moving mechanism 40 for moving the holder 29 includes a driving motor M as a driving source, a screw 41 and a drive transmitting portion 42. The driving motor M is mounted on the front block 22*a*. A rotation shaft of the driving motor M is provided with an unshown worm gear. The worm gear is engaged with an unshown drive receiving gear connected with one end portion of the screw 41. The screw 41 is rotatably supported by the front block 22*a* and the rear block 22*b* at the opposite end portions thereof with respect to the longitudinal direction (rotational axis direction), respectively. The screw 41 is bridged between the front block 22*a* and the rear block 22*b*. The screw 41 is an example of a rotatable member rotatable about a rotational axis extending along the longitudinal direction of the discharging electrode 23.

The outer periphery of the screw 41 is provided with a spiral groove, and the drive transmitting portion 42 is engaged with the spiral groove and is fixed on the holder 29. By this, the drive transmitting portion 42 is engaged with the screw 41 to move along the longitudinal direction of the charger 2 together with the holder 29 by the movement of the screw 41. That is, the drive transmitting portion 42 converts a rotational force of the screw 41 to a driving force directed along the longitudinal direction of the discharge wire 23 and then transmits the driving force to the holder 29. In this embodiment, the drive transmitting portion 42 is capable of connecting and disconnecting the holder 29 relative to the screw 41. More specifically, the drive transmitting portion 42 includes an engaging portion 42*a* engaged with the spiral groove of the screw 41, and a pressing portion 42*b* for pressing the engaging portion 42*a* in the diametrical direction of the screw 41 with a predetermined force. The engaging portion 42*a* of the drive transmitting portion 42 is movable relative to the screw 41 in the state of being urged toward the screw 41 by the pressing portion 42*b*. By this, even when the holder 29 abuts on an abutment member at the end portion of the movable range, the load for rotating the screw 41 does not increase beyond a predetermined level so that the screw 41 can continue rotating. Therefore, a time period in which the holder 29 can complete sufficient amount of movement is preset, and the rotation time period of the driving motor M can be set at a constant level.

As detecting means for detecting reaching of the holder 29 to the abutment member, a position sensor including a photo-interrupter may be provided. By doing so, when the reaching of the holder 29 to the end of the movable range, the subsequent operation such as stop of the rotation of the driving motor M or reverse rotation thereof can be started. In this case, the screw 29 is not required to rotate in the state that the holder 29 abuts on the abutment member. For example, a first position sensor for detecting that the holder 29 in the front end portion of the movable range and a second position sensor for detecting that the holder 29 is in the rear end portion may be provided.

In this embodiment, a control circuit 50 as a controlling means controls ON/OFF, the rotational moving direction or the like of the driving of the driving motor M.

The forward movement operation and the backward movement operation of the holder 29 may be carried out individually or continuously (reciprocation).

The timing of the execution of the cleaning operation for the discharge wire 23 and the grid member 24 by the cleaning pad 25 and the cleaning brush 26 may be set as follows. For example, when the control circuit 50 detects that a predetermined number of image formations are carried out, the holder 29 is moved to clean the surfaces of the discharge wire 23 and the grid member 24. In such a case, when the number of image formations reaches the predetermined number, the cleaning operation may be carried out with interruption of a job (a series of image forming operations for a single or multiple recording materials in response to one image formation starting instruction) or may be carried out immediately after the job is completed or before the start of the next job. Additionally, the cleaning operation may be carried out when a predetermined time period elapses without image forming operation, because there is a likelihood that the foreign matter may be deposited on the surface of the discharge wire 23 or the grid member 24, or the surface may corrode. For determination of the timing of the execution of the cleaning operation, the change, with time, over the foreign matter deposition on the discharge wire 23 and the grid member 24 and the change of the surface state thereof are acquired as data, on the basis of which the timing is properly determined.

5. Longitudinal disposition of charger and cleaning device

As described hereinbefore, the protection layer as the surface layer formed on the surface of the discharge wire 23 may become easily peeled off, if it is bent or subjected to local pressure by the nipping. The protection layer formed on the surface of the discharge wire 23 may be easily peeled if a boundary portion between the protection layer covering portion and the non-covering portion is rubbed. That is, by rubbing the discharge wire coated with carbon film as the surface layer, the carbon film may become easily peeled. It has been found that when the discharge wire is rubbed with the same pressure for the case (1) in which the carbon film is provided on the whole surface of the discharge wire and the case (2) in which there is a boundary between a carbon film covering portion and a not covering portion and the surface of the discharge wire, there is a difference in the easiness of the carbon film peeling. In the case (2), the boundary portion is the beginning or ending portion of the formation of the carbon film. Upon the rubbing with the same pressure, the carbon film is more easily peeled off in the case (2) than in the case (1). The state of the peeling of the carbon film has been observed using a microscope, and it has been understood that the rubbing bites a small stepped portion formed by the presence and absence of the carbon film, and the carbon film is relatively easily peeled from the stepped portion at the boundary portion.

Under the circumstances, in this embodiment, the range of the formation of the protection layer of the discharge wire 23 is determined such that the easy peeling of the protection layer is suppressed.

Figure 8:
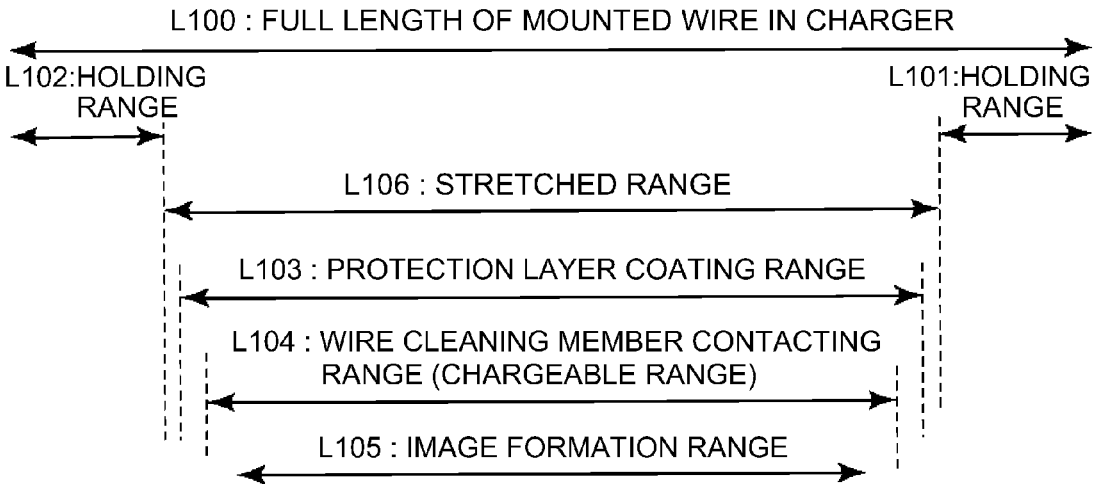
FIG. 8 is an illustration of a range in which a surface layer is provided on the discharge wire of the corona discharger.

FIG. 8 shows a positional relation among the various elements in the longitudinal direction of the charger 2 in this embodiment.

A length, measured in the longitudinal direction of the charger 2, of the opening 2*a* of the charger 2 defined by the shield case 21, the front block 22*a* and the rear block 22*b* is 360 mm. The opening 2*a* is the influential range of the discharge from the discharge wire 23 relative to the photosensitive drum 1. The range of the opening 2*a* in the longitudinal direction of the charger 2 is called "chargeable range". That is, the length L104 of the chargeable range in the longitudinal direction of the charger 2 is the same as the length of the opening 2*a* in the longitudinal direction of the charger 2, i.e. 360 mm. More specifically, the chargeable range ranges in ±180 mm from the center of the image forming region in the longitudinal direction of the charger 2, in which "+" means the front side of the charger 2, and "−" means the rear side.

A length L105 of the image forming region measured in the longitudinal direction of the charger 2 is 330 mm which is smaller than the length of the chargeable range. In other words, the image forming region ranges in ±165 mm from the center of the image forming region in the longitudinal direction of the charger 2, in which "+" means the front side of the charger 2, and "−" means the rear side. That is, the image forming region having the length L105) is inside the chargeable range (L104) in the longitudinal direction of the discharge wire 23.

In addition, the existence of the charging unevenness in the chargeable range is not preferable, and therefore, the cleaning pad 25 can clean the entirety of the chargeable range. As described hereinbefore, the cleaning pad 25 removes the foreign matter from the surface of the discharge wire 23 while contacting and rubbing the surface of the discharge wire 23. In other words, the length of the contact region (cleaning member contact region) in which the cleaning pad 25 contacts the discharge wire 23, measured in the longitudinal direction is 360 mm which is the same as the length L104 of the chargeable range. More specifically, the cleaning member contact region ranges in ±180 mm from the center of the image forming region in the longitudinal direction of the charger 2, in which "+" means the front side of the charger 2, and "−" means the rear side.

In the case that there is a boundary portion in the cleaning member contact region between a protection layer portion (coated region) and a non-protection layer portion (non-coated region), the protection layer is easily peeled from the boundary portion. Therefore, it is preferable that the boundary portion of the protection layer (surface layer) of the discharge wire 23 is not provided in the cleaning member contact region. Then, in this embodiment, the protection layer is formed in the range wider than the cleaning member contact region in the longitudinal direction of the charger 2. That is, in this embodiment, the length L103 of a film formation area (coated region) of the protection layer of the discharge wire 23 in the longitudinal direction of the charger 2 is 365 mm larger than the length L104 (=360 mm) of the cleaning member contact region in the longitudinal direction of the charger 2. More particularly, the film formation area as the coated region ranges in ±182.5 mm from the center of the image forming region in the longitudinal direction of the charger 2, in which "+" means the front side of the charger 2, and "−" means the rear side. That is, in the longitudinal direction of the discharge wire 23, the cleaning member contact region (L104) is inside the film formation area (L103) of the protection layer.

A total length L100 of the discharge wire 23 in the longitudinal direction of the charger 2 in the state that it is mounted in the charger 2 is 400 mm. In the total length L100 range of the discharge wire 23, the longitudinal opposite end portions of the discharge wire 23 are holding areas for the mounting of the discharge wire 23 and for the adjustment of the distance relative to the photosensitive drum 1 in the front holding portion 61 and the rear holding portion 62. A length L101 of the holding area in one of the longitudinal end portions of the discharge wire 23 in the front side of the charger 2, and a length L102 of the holding area on the other of the longitudinal end portions of the discharge wire 23 in the rear side of the charger 2 are both approx. 15 mm. In the holding areas, as described hereinbefore, the discharge wire 23 is bent, or the discharge wire 23 is locally pressed in order to fix and position the discharge wire 23. For this reason, if the protection layer exists in the holding area, the portion of the protection layer subjected to the pressure or bending may be cracked or peeled relatively easily. If the crack or peeling occurs locally in the protection layer, the peeling of the protection layer becomes easy from the portion of the crack or peeling. Therefore, it is preferable that the protection layer not be provided in the holding area where the discharge wire 23 is bent or locally pressed. In this embodiment, the protection layer is provided in the range narrower than the range between the holding area in the opposite end portion sides of the charger 2 with respect to the longitudinal direction of the charger 2 (stretched area). More specifically, the stretched area ranges (most inside range) between the portions where the discharge wire is bent, nipped or pressed on the holding portions 61, 62 at the longitudinal opposite end portion sides of the discharge wire 23. In this embodiment, in response to the distance between the connecting position Fa and the positioning portion Fb shown in parts (a) and (b) of FIG. 6, the length of the stretched area L106 (=L100−L101−L102) measured in the longitudinal direction of the charger 2 is 370 mm. More specifically, the stretched area ranges substantially in ±185 mm from the center of the image forming region in the longitudinal direction of the charger 2, in which "+" means the front side of the charger 2, and "−" means the rear side. As described hereinbefore, the length L103 of the protection layer film formation area of the discharge wire 23 measured in the longitudinal direction of the charger 2 is 360 mm which is smaller than the length L106 of the stretched area measured in the longitudinal direction of the charger 2. That is, in the longitudinal direction of the discharge wire 23, the film formation area (L103) of the protection layer is inside the stretched area (L106).

Thus, in this embodiment, the length L103 of the film formation area is larger than the length L104 of the cleaning member contact region. In other words, L104<L103 is satisfied. In addition, the film formation range L103 is smaller than a length L106 (=L100−L101−L102) of the stretched area. That is, L103<L106 is satisfied. From the foregoing, according to this embodiment, the length L103 of the film formation area satisfies L104<L103<L106 (=L100−L101−L102). In this embodiment, the ranges having the lengths L100, L103−L106 extend in the front side and the rear side of the charger 2 from the common center. Therefore, the film formation area of the protection layer (L103) is inside the stretched area (L106), and the cleaning member contact region (L104) is inside the film formation area (L103) of the protection layer. By this, the crack or peeling of the formed protection layer can be suppressed.

6. Protection Layer of Discharge Wire 6-1. Chemical Property:

As described in the foregoing, in this embodiment, the discharge wire 23 comprises the base material which is the tungsten wire and the protection layer as the surface layer film of ta-C (Tetrahedral Amorphous Carbon) coating the surface of the base material.

The ta-C is classified as a diamond-like carbon (DLC) and has a high chemically non-active property against the electric discharge product and a high parting property against the floating matter in the air. The structure of the DLC is ordinarily an amorphous structure of a mixture of diamond bond (or sp3 bond) containing a small amount of hydrogen and graphite bond (or sp2 bond).

Figure 9:
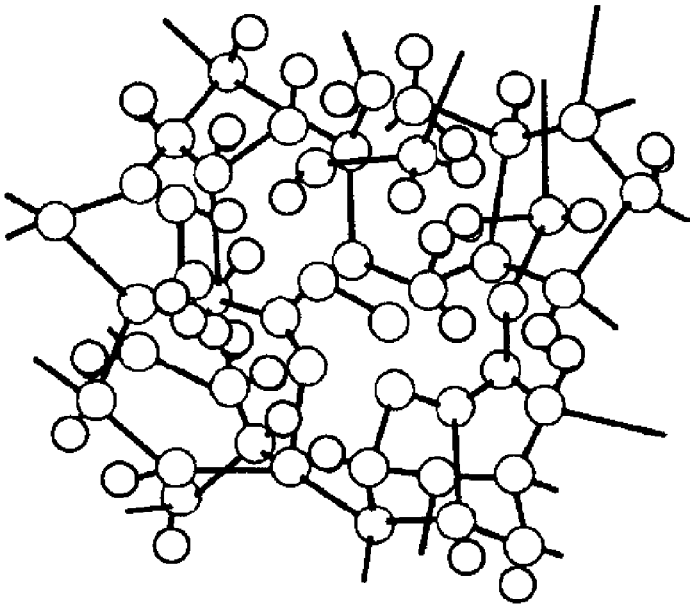
FIG. 9 is a schematic view illustrating a structure of ta-C.
Figure 10:
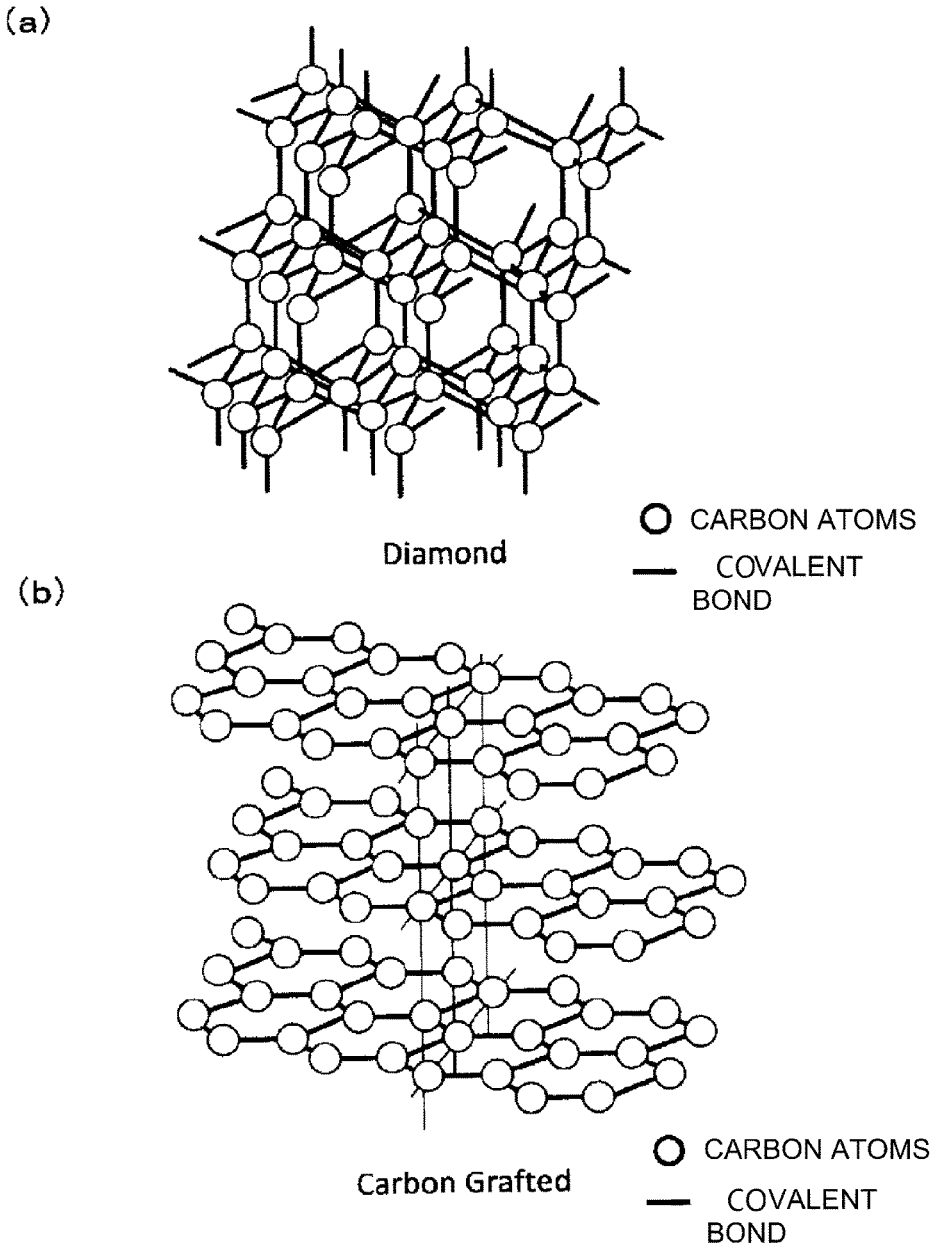
FIG. 10 is a schematic view illustrating a diamond structure and a graphite structure.

FIG. 9 is a schematic view illustrating the structure of ta-C. White circles (o) depict the carbon atoms, and the lines (-) depict the bond state. The ta-C has a tetrahedron structure microscopically, and is a chemical species having an amorphous structure, macroscopically. The ta-C comprises a mixture of sp3 bond and sp2 bond and has, as a composition, the sp3 bond (diamond structure) sensitive to the hardness and the sp2 bond (graphite structure) sensitive to the slidability. Therefore, the anti-friction property and anti-wearing property change depending on the ratio of the bonds. As shown in part (a) of FIG. 10, when only the carbon atoms are crystallized only at the sp3 hybrid orbital, the structure is the diamond structure. Similarly, as shown in part (b) of FIG. 10, if it is the carbon atoms having the sp2 hybrid orbital, the structure is the graphite (graphite) structure.

The ta-C having such structures is better in non-active property, anti-corrosion property, low wearing property, self-lubricating, high hardness and surface smoothness against air and water, as compared with another material. In addition, the ta-C has a property against chemical attraction and oxidative reaction, and is useful against partial function deterioration attributable to wearing and/or damage. Therefore, even when the foreign matter floating around the discharge wire 23 is deposited on the surface of the discharge wire 23, it is easily separated therefrom.

It is preferable that the volume resistivity, the film thickness and the surface smoothness property of the protection layer (ta-C layer) formed on the surface of the discharge wire 23 are optimized so that the anti-corrosion effect without impeding the charging property is maximized. For the volume resistivity, the material property is adjusted to provide the volume resistivity (intermediate resistance) suitable for the charging member. Therefore, the volume resistivity of the protection layer (ta-C layer) is preferably approx. 10ˆ7-10ˆ 10 Ωcm. In this embodiment, the protection layer (ta-C layer) is formed to provide a volume resistivity of approx. 10ˆ8-10ˆ9 Ωcm which is a further preferable. In addition, in this embodiment, the ratio of the sp3 bond to the sp2 bond (sp3:sp2) is made 9:1-7:3 by selecting the film formation condition of the ta-C.

6-2. Forming Method of Protection Layer:

In this embodiment, the ta-C layer is formed on the base material (tungsten wire) of the discharge wire 23 using a FCVA (Filtered Cathodic Vacuum Arc Technology) method. The ta-C is better in the anti-corrosion property or the like than Cr, but the coating method is limited. More specifically, in order to coat the surface of the wire, sputtering is ordinary.

In the coating by the evaporation, the wire is held in a low pressure protection layer formation chamber, and the material of the protection layer is blown unidirectionally, as contrasted to the liquid plating in which the base material is seeped. Therefore, in order to form the protection layer on the whole peripheral surface of the wire, the wire is rotated in the low pressure chamber.

The formation of the protection layer may be called lining, facing or coating. It may be also called as surface treatment covering all of them.

When the ta-C layer is formed on the base material by the FCVA method, carbon plasma is produced by vacuum arc discharge of graphite, and the carbon ionized thereby is extracted and is laminated on the base material. In place of the FCVA method, PVD (Physical Vapor Deposition) method, CVD (Chemical Vapor Deposition) method or the like may be used. Depending on the material of the protection layer, the proper processing method may be selected, and the present invention is not limited to a particular said processing method.

6-3. Formation of Protection Layer on Wire:

The film formation of the protection layer by the evaporation such as the FCVA involves a directivity property. That is, the growth speed is different between the surface to which the material of the protection layer of the wire is blown and the surface opposite therefrom. Therefore, in order to form the protection layer all over the peripheral surface of the wire, the wire is rotated in the evaporation chamber. By rotating the wire during the evaporation, a sufficient thickness of the protection layer can be formed all over the peripheral surface of the wire. The thickness of the protection layer formed on the surface of the wire is preferably not less than 0.02 μm.

A surface property of the wire after the formation of the protection layer (ta-C layer) will be described. When the roughness of the surface of the ta-C layer is high, the area of the outer surface of the ta-C layer formed on the surface of the wire is large. If the surface area of the ta-C layer is large, the likelihood that the electric discharge product, aerosol, scattered toner or externally added material deposit on the surface of the ta-C layer increases. Such deposition and/or corrosion may result in production of image defect. Therefore, it is preferable that the surface of the ta-C layer is made smooth.

6-4. Film Formation Condition of ta-C Layer:

The condition of the protection layer (ta-C layer) formation will be described in detail.

The film formation temperature is preferably not less than 0 degree C. and not more than 350 degree C., further preferably not less than 40 degree C. and not more than 220 degree C. In this embodiment, the film formation speed is 1.5 nm/sec, and the wire is rotated in the film formation chamber to provide the film thickness of 0.10 μm so that coating is uniform all over the peripheral surface of the wire.

Here, if there is a difference in color between the material of the base material and the protection layer, the film thickness can be acquired by detecting the optical density. More particularly, the SUS, for example, is silver white with metal glossiness, and the color of the ta-C changes depending on the film thickness gradually from reddish brown to mulberry (ultramarine blue), and then to bluish silver. Therefore, the film thickness can be detected by the coloring and density difference. However, when the material of the protection layer is transparent or the same or similar in the color, the discrimination is not possible only by the color. When the layer thickness is measured accurately in such a case, a cross-section is seen through an electron microscope.

In the case that amorphous carbon (ta-C) is used as the material of the protection layer, the protection layer contains sp3 structure and sp2 structure of carbon at a certain ratio. The investigations by the inventor have revealed that if the ratio of the sp3 structure is larger than the sp2 structure, the anti-corrosion property and the anti-wearing property are higher. This is considered as being because if the ratio of the sp2 structure is large, micro hole filling easily occurs between graphite surface layers, and therefore, it can easily attract or be filled with the other chemical species (ozone, electric discharge product, liberation base in this embodiment). As regards the corrosion per se, there is no difference between the compositions, but the influence of the other factors (rust of another element) is thought to be related. On the other hand, by increasing the ratio of the sp3 structure, a nano-level dense structure is provided, and the ratio of the crystalline structure can be increased, which is considered as being influential to the problem caused by the other factors.

The ratio sp3:sp2 of the sp3 structure and the sp2 structure in the ta-C layer is preferably not less than 6:4 (ratio of the sp3 structure is large). It is further preferable that sp3:sp2 is not less than 7:3. In this embodiment, the ratio is sp3:sp2=7:3.

The ratio of the sp3 structure and the sp2 structure can be detected using a Raman microscope (RAMAN-11 available from Nanophoton Inc., for example). More specifically, the ta-C layer is illuminated with a laser beam (monochromatic light) from a light source, and the produced Raman scattered light is detected by a spectroscope or an interferometer to obtain a spectral distribution. From the peaks in the obtained spectral distribution, the ratio of the sp3 structure and the sp2 structure can be calculated.

Of the film formation methods capable of providing different ratios, the following method may be used in addition to the FCVA method. A laser ablation method disclosed in Japanese Laid-open Patent Application No. 2005-15325 and a high frequency magnetron sputtering method disclosed in Vol.24, No.7, pp.411-416 of the Journal of the Surface Science Society of Japan are usable. The protection layer having the various ratios can be provided by selecting the substrate temperature, the pulse voltage, the assist gas flow rate, the ambient gas and annealing process temperature.

According to this embodiment, the anti-wearing property and the anti-adherence property can be improved in addition to the anti-corrosion property by coating the discharge wire 23 with the ta-C layer. By this, the occurrence of the image defect attributable to the wearing, the deposition of the foreign matter in addition to the corrosion of the discharge wire 23 can be suppressed for a long term. The material of the surface layer of the discharge wire 23 is preferably ta-C, but another material comprising carbon is usable.

7. Durable of Protection Layer

The durability of the discharge wire coated with the protection layer will be described.

7-1. Bending test of wire:

Table 1 shows results of a bending test of the discharge wire coated with the ta-C layer. The bending test is as follows. A discharge wire comprising a tungsten wire having a diameter of 60 μm and ta-C of 0.10 μm thick on the surface of the wire is prepared. The discharge wire is bent at a certain point. The state of the coating at the bent portion (certain angle) is observed using an optical microscope. If the state of the protection layer observed by the optical microscope is equivalent to the state before the bending, that is, there is no crack or peeling, the result of discrimination is indicated "o" (Good). If unsmoothness which is considered as being a sign of a coming crack or peeling on the protection layer is seen, the result of discrimination is indicated "Δ" (slightly poor). If a crack or peeling of the protection layer is seen to such an extent that the surface of the wire is exposed, the result of discrimination is indicated "x" (no good).

TABLE 1

| | Bending angle (degree) | | | | | | | | |
|---|---|---|---|---|---|---|---|---|---|
| | 20 | 30 | 40 | 50 | 60 | 80 | 100 | 140 | 180 |
| Surface state | ○ | ○ | Δ | X | X | X | X | X | X |

As will be understood from Table 1, when the bending angle of the discharge wire is not more than 30°, no crack or peeling is produced on the protection layer. However, if the bending angle of the discharge wire is close to 40°, the unsmoothness which is thought as being the sign of the coming crack or peeling of the protection layer is observed. If the bending angle of the discharge wire is not less than is 50°, a crack or peeling is apparently produced on the protection layer.

The tolerable bending angle is different depending on the easiness of peeling resulting from the structures of the protection layer. Here, the bending (strongly curving) of the discharging electrode to such an extent beyond a tolerable level of the protection layer is called "hard bending". As will be understood from the results of the bending test, the hard bending of the discharging electrode means the bending not less than 40° (strongly curved). As shown in part (a) of FIG. 6, when the discharge wire is tied on the projection, the discharge wire is to be bent not less than 40° normally.

In addition, the surface of the discharge wire when the discharge wire is pressed by the urging member, as shown in part (b) of FIG. 6, or when the discharge wire is nipped by the screw or plate-like members as shown in parts (a) and (b) of FIG. 7, for example, the pressure is applied locally, has been observed using the optical microscope. As a result, it has been found that the crack or peeling is observed on the protection layer.

As described in the foregoing, if the wire protection layer is subjected to the load by the hard bending or local pressure application of the discharge wire, the protection layer coating is cracked or peeled. And, if the crack or peeling of the protection layer is produced at the point, the protection layer is easily peeled from the point, irrespective of the magnitude of the crack or peeling.

According to this embodiment, the protection layer is not provided in the holding area for the discharge wire 23 where the fixing portion Fa and/or the positioning portion Fb is provided and where the discharge wire 23 is subjected to the hard bending or local pressure. By this, the production of the crack or peeling of the protection layer can be suppressed.

7-2. Repetition Test Of Cleaning Operation For Discharge Wire:

Table 2 shows the result of repetition test of the cleaning operation in which the cleaning operation for the discharge wire is periodically carried out while executing the image formations. The repetition test is carried out as follows. The image forming operation and the discharge wire cleaning operation are repeated at a ratio of one cleaning operation for each 1000 image formations. In order to compare the durabilities against the cleaning operations, the tests are carried out under conditions 1 and 2 in which the size relation between the length L103 of the film formation area of the protection layer and the length L104 of the cleaning member contact region are as has been described in conjunction with FIG. 8. The conditions 1 and 2 are as follows. In each of the comparison example and this embodiment, the film formation area of the protection layer and the cleaning member contact region extend from a common center toward the front side and the rear side of the charger 2.

Condition 1 (comparison example): L104 (370 mm) >L103 (365 mm)

Condition 2 (this embodiment): L104 (360 mm) <L103 (365 mm)

The criterion for evaluation "o" (good), "Δ" (slightly poor), "x" (no good), is the same as with the bending test. The structures of the chargers 2 in the conditions 1 and 2 are the same except for the difference in the film formation area.

TABLE 2

| | No. of Image Formations (×1000) | | | | | | |
|---|---|---|---|---|---|---|---|
| | 50 | 100 | 200 | 300 | 400 | 500 | 1000 |
| Condition 1 | ○ | ○ | Δ | X | X | X | X |
| Condition 2 | ○ | ○ | ○ | ○ | ○ | ○ | ○ |

As will be understood from Table 2, in the case of condition 1 (comparison example), unsmoothness like a burr is observed at the boundary portion between the protection layer coating the area and the non-coating area, when the number of image formations exceeds approx. 200,000. As a result of further continuance of the tests, when the number of image formations exceeds 300,000, the unsmoothness like the burr at the boundary grows to such an extent that a peeling of the production layer is confirmed. As a result of further continuance of the tests beyond 400,000 image formations, the peeling gradually expands, and when the number reaches 1,000,000, a percentage of the protection layer on the surface of the discharge wire has been completely peeled off.

On the other hand, in the case of condition 2 (this embodiment), no crack or peeling of the protection layer is observed after 1,000,000 cleaning operations.

Thus, it is understood that if the cleaning pad contacts the boundary portion between the protection layer coating area and the non-coating area, the protection layer becomes easily peeled.

On the other hand, according to this embodiment, the cleaning area using the cleaning pad is set so that the boundary portion between the protection layer coating area and the non-coating area of the discharge wire is not contacted by the cleaning pad. By doing so, the occurrence of the easy peeling tendency of the protection layer can be suppressed.

As described in the foregoing, according to the present invention, the crack or peeling of the protection layer provided on the surface of the discharge wire 23 is suppressed, and the protection layer can be maintained for a long term. By this, the deposition of the foreign matter on the discharge wire 23 and the corrosion thereof can be suppressed for a long term. Therefore, the occurrence of the defective image attributable to the uneven charging of the photosensitive drum 1 can be suppressed for a long term.

Others:

In the foregoing, the present invention has been described, taking specific examples, but the present invention is not limited to the embodiment described above.

The suppression of the crack or peeling in the holding portion, and the suppression of the peeling attributable to the rubbing by the cleaning member are individually effective to provide the respective advantageous effects. That is, in the corona discharger, the discharging electrode can be provided with the surface layer of the material comprising carbon on a base material, and the surface layer can be provided in the area other than the area where the discharging electrode is supported while being subjected to the hard bending, the nipping or the pressing. In addition, in the corona discharger, the discharging electrode can be provided with the surface layer of the material comprising carbon on a base material, and the surface layer can be provided outside the area in which the boundary between the surface layer coating area and the non-coating area of the discharging electrode is contacted by the cleaning member. As described hereinbefore, if a part of the protection layer is cracked or peeled, the protection layer becomes easily peeled off. Therefore, by accomplishing both of the suppression of the crack or peeling in the holding portion and the suppression of the peeling attributable to the rubbing with the cleaning member, they are synergistically effective to drastically improve the lifetime of the discharging electrode.

In the above-described embodiment, the corona discharger (corona discharge generator) has been described as a charger for electrically charging the surface of the photosensitive member, but the present invention is not limited to such an example. For example, the corona discharger is usable as toner charging means for electrically charging the toner image on the image bearing member before the image transfer, untransferred toner charging means for electrically charging untransferred toner remaining on the image bearing member after the image transfer, or the like. In addition, the corona discharger is usable as discharging means for electrically discharging the surface of the image bearing member, transferring means for transferring the toner image from the image bearing member onto a toner image receiving member, or the like. In such cases, the image bearing member is not limited to the photosensitive member but may be an intermediary transfer member. In the case that the corona discharger is used for the above-described usage, the above-described advantageous effects can be provided by using the present invention in the same manner.

In the foregoing, the description has been made as to a corona discharger used with an image forming apparatus, but the present invention is not limited to such a usage. The present invention is usable as a corona discharger with the same advantageous effects in electrical equipment such as an electrical dust collector for attracting and removing dust from the air, or a gas cleaning device for decomposing bad smell or noxious gas.

INDUSTRIAL APPLICABILITY

According to the present invention, a corona discharger is capable of suppressing production of the crack on the surface of the discharge wire.

REFERENCE NUMERALS

1: photosensitive drum
2: charger
21: shield case
22: front block
22*b*: rear block
23: discharge wire
24: grid member
61: front holding portion
62: rear holding portion

The invention claimed is:

1. A corona discharger comprising:

a discharge wire stretched in said corona discharger and configured to electrically discharge by being supplied with a voltage, said discharge wire including a base material of metal, and a surface layer comprising diamond-like carbon formed on said base material;

a first connecting portion configured to connect one end portion of said discharge wire; and a second connecting portion configured to connect the other end portion of said discharge wire, wherein said discharge wire includes a coated region coated with said surface layer and non-coated regions not coated with said surface layer on opposite sides of the coated region with respect to a longitudinal direction of said discharge wire, respectively, and wherein the one end portion and the other end portion of said discharge wire are in the non-coated regions, respectively.

2. A corona discharger according to claim 1, wherein said discharge wire is connected with said first connecting portion at the one end portion, and is connected with said second connecting portion at the other end portion.

3. A corona discharger according to claim 1, further comprising an urging member configured to urge said discharge wire to adjust a position of said discharge wire, a portion of said discharge wire urged by said urging member being in the non-coated region.

4. A unit comprising a corona discharger according to claim 1, and a rotatable photosensitive member to be charged by said corona discharger, wherein a toner image is capable of being formed on a surface of said photosensitive member charged by said corona discharger, and wherein a region, with respect to the longitudinal direction of said discharge wire, of said discharge wire corresponding to a maximum area in which the toner image is formed with respect to a longitudinal direction of said photosensitive member is in the coated region.

5. A corona discharger according to claim 1, wherein said surface layer comprises tetrahedral amorphous carbon.

6. A corona discharger according to claim 1, further comprising a cleaning member configured to clean said discharge wire by moving along in contact with said discharge wire in a cleaning region with respect to the longitudinal direction, wherein the cleaning region is inside the coated region with respect to the longitudinal direction.

7. A corona discharger according to claim 6, wherein said cleaning member includes felt configured to nip said discharge wire.

8. A corona discharger according to claim 6, wherein said surface layer comprises tetrahedral amorphous carbon.

9. A corona discharger according to claim 1, further comprising an urging portion configured to urge said discharge wire for adjusting a distance between said discharge wire and a member to be charged, wherein said urging portion is in one of the non-coated regions with respect to the longitudinal direction.

10. A corona discharger according to claim 9, wherein said surface layer comprises tetrahedral amorphous carbon.

* * * * *